US005344628A

United States Patent [19]

Martin

[11] Patent Number: 5,344,628

[45] Date of Patent: Sep. 6, 1994

[54] METHOD FOR INTRODUCING AND METERING A LIQUID TREATMENT MEDIUM IN COMBUSTION PROCESSES

[75] Inventor: Johannes J. E. Martin, Seeshaupt, Fed. Rep. of Germany

[73] Assignee: Martin GmbH fur Umwelt-und Energietechnik, Munich, Fed. Rep. of Germany

[21] Appl. No.: 61,370

[22] Filed: May 13, 1993

Related U.S. Application Data

[63] Continuation of Ser. No. 601,217, Oct. 19, 1990, abandoned.

[30] Foreign Application Priority Data

Oct. 24, 1989 [DE] Fed. Rep. of Germany ..... 3935401

[51] Int. Cl.[5] ..... B01D 53/34

[52] U.S. Cl. ..... 423/235; 423/239.1

[58] Field of Search ..... 423/235, 239

[56] References Cited

U.S. PATENT DOCUMENTS

| | | | |
|---|---|---|---|
| 4,842,834 | 6/1989 | Burton | 423/239 |
| 5,045,292 | 9/1991 | Ruegg et al. | 423/239 |

FOREIGN PATENT DOCUMENTS

| | | |
|---|---|---|
| 0185630 | 6/1986 | European Pat. Off. . |
| 1057985 | 5/1959 | Fed. Rep. of Germany . |
| 3541599 | 5/1986 | Fed. Rep. of Germany . |
| 3935400 | 8/1990 | Fed. Rep. of Germany . |

*Primary Examiner*—Michael Lewis
*Assistant Examiner*—Thomas G. Dunn, Jr.
*Attorney, Agent, or Firm*—McAulay Fisher Nissen Goldberg & Kiel

[57] ABSTRACT

A method for introducing and metering a liquid treatment medium into the waste gas flow in combustion processes where the liquid treatment is metered and injected into a mixing chamber, under pressure. In addition, a carrier medium, also under pressure, is metered and injected into the same mixing chamber. This mixture is then sprayed, as a result of a pressure difference, from the mixing chamber, through a nozzle achieving atomization, and into the flue serving as an exhaust for the waste gas flow.

4 Claims, 1 Drawing Sheet

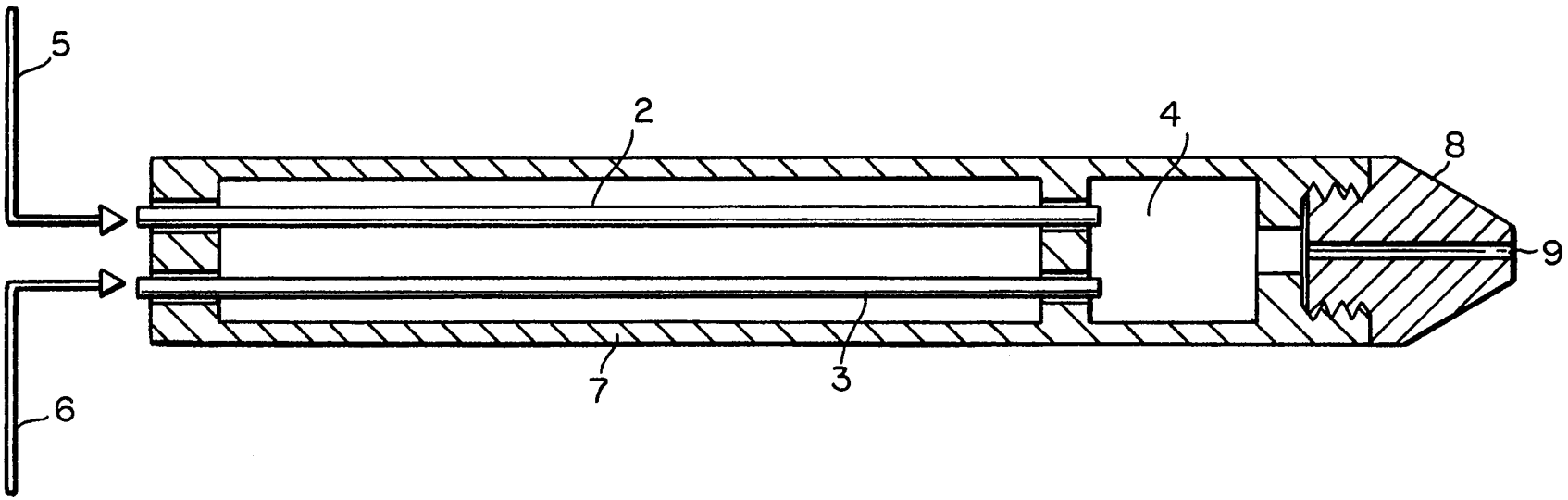
5
6
2
7
4
3
8
9

METHOD FOR INTRODUCING AND METERING A LIQUID TREATMENT MEDIUM IN COMBUSTION PROCESSES

This is a continuation of application Ser. No. 07/601,217, filed Oct. 19, 1990, now abandoned.

BACKGROUND OF THE INVENTION

1. Field of the Invention

The invention is directed to a method for introducing and metering a liquid treatment medium into the waste gas flow in combustion processes. The invention is also directed to an atomizing nozzle, particularly for implementing the method.

2. Description of the Prior Art

In order to introduce a treatment medium, e.g. chemicals for reducing the $NO_x$ content in waste gases, it is known to atomize the chemicals by means of a carrier medium in a two-component nozzle and thus introduce it into the combustion chamber. However, the two-component nozzle has the disadvantage that steam or compressed air is supplied as atomizing medium or carrier medium, so that an unwanted dilution of the flue gases with air or steam occurs, which reduces the efficiency of the steam production or, in some cases, of the waste gas cleaning system because a large quantity of this medium is required for the atomization. The atomization in a two-component nozzle is effected by means of kinetic energy of the atomizing medium, which causes the high throughput of this medium. Moreover, these atomizing media are expensive, since they require increasingly high amounts of energy and, in the event that steam is applied, prepared evaporator feed water. The guidance of these media through lines until the individual nozzles proves costly, since either thermally insulated pipes must be used in the case of steam or relatively large cross sections must be used for reducing the pressure loss in the system. The expansion of the media at the nozzle outlet and the media flow in the lines generate a relatively high noise level which often even necessitates soundproofing.

A method and an atomizing nozzle for admixing an atomized liquid into a gas flow is known from DE-OS 35 41 599, in which the atomized liquid, together with the atomizing gas, is divided into a plurality of partial flows, wherein every partial flow has a component in the same direction as that of the gas flow in which the atomized liquid is to be introduced. In this method, by means of a two-component nozzle comprising two concentric pipes, the liquid to be atomized is guided in the inner pipe and the atomization gas is guided in the outer pipe, which atomization gas atomizes the liquid at the opening of the inner pipe. In so doing, the atomized liquid is first introduced into a distributor chamber from which a plurality of pipes proceed diagonally relative to the flow direction of the gas flow so that the waste gas flow to be treated can flow around the outlet openings of these distributor pipes on all sides in order to prevent the atomized liquid from being baked on at the outlet end of the pipes. In a simple two-component nozzle, in which the atomized liquid emerges in the flow direction of the gas flow to be treated, the atomized liquid can settle at the outlet opening of the two-component nozzle because of the turbulence at the latter. In addition to the disadvantages already discussed above with respect to a two-component nozzle, this known two-component nozzle also has the disadvantage that the metering of the liquid to be atomized presents difficulties, since the pipe of the two-component nozzle for conveying the liquid to be atomized has a determined delivery capacity and this quantity can not be throttled too sharply because, otherwise, a uniform atomization of the liquid does not occur.

SUMMARY OF THE INVENTION

The present invention has the object of providing a method and an atomizing nozzle for introducing and metering a liquid treatment medium into the waste gas flow in combustion processes, by means of which a simple and reliable metering of the treatment medium to be atomized is ensured with low expenditure with respect to construction and energy.

This object is met, according to the invention, in that the liquid treatment medium and a liquid carrier medium are introduced under pressure in desired quantitative proportion to one another into a mixing chamber, mixed in the latter and sprayed from a common atomizing opening exclusively on the basis of the pressure difference between the mixing chamber and the external surroundings of the atomizing opening. In this method, in which the two media are introduced under pressure, preferably under equal pressure, and mixed, the quantitative proportion of treatment medium to carrier medium can vary as desired in the range of 0 to 100%, since the mixing chamber is constantly filled with a liquid medium and the necessary atomization pressure can be maintained constantly, specifically regardless of whether there is any treatment medium or whether there is exclusively only treatment medium. Accordingly, it is possible to regulate the ratio of treatment medium to atomization medium in a uniform or continuous manner. The quantity of treatment medium to be atomized can be adjusted by means of changing the mixture ratio of treatment medium and carrier medium simply and quickly by means of regulating the quantity of the treatment medium or carrier medium which are supplied under pressure. Thus, it is possible e.g. to atomize only pure treatment medium and to turn off the carrier medium, and vice versa. If only carrier medium is sprayed from the nozzle, this carrier medium serves to cool the nozzle when the carrier medium is e.g. water.

The quantities of energy to be used are very small, since the media can be brought to the necessary atomization pressure by means of simple pumps. Moreover, no substantial noise arises from the flow of the media in the lines, which need not be thermally insulated or soundproofed, so that the structural cost for the entire apparatus is low.

The atomizing nozzle for the introduction of a liquid treatment medium into the waste gas flow in combustion processes, which is used in particular for implementing the method, is characterized in that the atomizing nozzle is constructed as a one-component nozzle which comprises a pressure feed line for the liquid treatment medium, as well as a pressure feed line for a liquid carrier medium, as well as a mixing chamber to which a single atomizing opening is directly connected. The atomization is thus effected exclusively on the basis of the pressure difference between the mixing chamber and the external surroundings of the nozzle, wherein this pressure difference can be adjusted high enough so that return flows of the atomized treatment medium and the baking on at the nozzle associated with the latter can not occur, so that the spray-in direction can be adjusted as desired in the flow direction of the waste gas flow to be treated. Moreover, the construction of the atomizing nozzle, which is connected directly to the mixing chamber into which the two pressure feed lines open, is extremely simple, since the atomizing nozzle only comprises a single atomizing opening.

In another construction of the invention, when the mixing chamber has a volume which is sufficient for atomization in a few seconds, a maximum of 30 seconds, it is ensured that a regulating process requiring quick changes in the mixture ratio or a quick turning off of the nozzle can be implemented easily, since only a small quantity with a respective adjusted mixture ratio is present in the mixing chamber.

BRIEF DESCRIPTION OF THE DRAWING

The invention is explained in more detail in the following with the aid of the drawing which shows an embodiment example of an atomizing nozzle in longitudinal section.

DESCRIPTION OF THE PREFERRED EMBODIMENT

The atomizing nozzle, according to the single drawing, comprises a nozzle body 1 which comprises pressure feed lines 2 and 3 on the one hand and a mixing chamber 4 on the other hand. The pressure feed lines 2 and 3 open into the mixing chamber 4 and are connected at their other ends with a feed line 5 for the treatment medium on the one hand and with a feed line 6 for the carrier medium on the other hand. A nozzle head 8, which can be screwed on the nozzle body 1 and comprises a single atomizing bore hole 9 from which the mixture of carrier medium and treatment medium emerges and is finely atomized on the basis of the prevailing pressure difference inside and outside the atomizing nozzle, is directly connected to the mixing chamber 4 in which the carrier medium and the treatment medium are mixed together. The mixing chamber 4 has only a low volume, so that when the mixture ratio of treatment medium and carrier medium is changed, there is only a small after-running of already mixed substances, i.e. the change can be made very quickly if the mixing chamber 4 has a low volume.

I claim:

1. A method for introducing and metering the liquid treatment medium effective for reducing $NO_x$ into the waste gas flow in combustion processes for reducing the $NO_x$ content of the waste gas flow, comprising the steps of:

(1) pressurizing the liquid treatment medium at a first pressure;

(2) pressurizing a liquid carrier medium at a second pressure;

(3) delivering said liquid treatment medium and said liquid carrier medium in adjustable amounts to a mixing chamber to form a liquid mixture at a third pressure; and, (4) spraying said liquid mixture into an area having a fourth pressure to contact the waste gas flow and reduce the $NO_x$ content;

wherein said liquid mixture is atomized solely by a single-component nozzle positioned to spray said liquid mixture into the area and said spraying step is effected when said third pressure exceeds said fourth pressure.

2. The method of claim 1, wherein said first pressure is equal to said second pressure.

3. The method of claim 1, wherein said mixing chamber has a maximum volume which is emptied by said spraying step in a few seconds.

4. The method of claim 1, wherein said mixing chamber has a maximum volume which is emptied by said spraying step in no more than 30 seconds.

* * * * *